US012173941B2

(12) United States Patent
Groll et al.

(10) Patent No.: US 12,173,941 B2
(45) Date of Patent: Dec. 24, 2024

(54) SMART ACCUMULATOR WITH OIL CIRCULATION RATIO SENSING

(71) Applicant: Purdue Research Foundation, West Lafayette, IN (US)

(72) Inventors: Eckhard Achim Groll, West Lafayette, IN (US); James Edward Braun, West Lafayette, IN (US); Orkan Kurtulus, West Lafayette, IN (US); Parveen Dhillon, West Lafayette, IN (US); Vatsal Manilal Shah, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 326 days.

(21) Appl. No.: 17/829,002

(22) Filed: May 31, 2022

(65) Prior Publication Data

US 2022/0390156 A1 Dec. 8, 2022

Related U.S. Application Data

(60) Provisional application No. 63/196,891, filed on Jun. 4, 2021.

(51) Int. Cl.
*F25B 43/00* (2006.01)
*F25B 49/02* (2006.01)

(52) U.S. Cl.
CPC ..... *F25B 43/006* (2013.01); *F25B 49/02* (2013.01); *F25B 2400/03* (2013.01);
(Continued)

(58) Field of Classification Search
CPC ..... F25B 43/006; F25B 2700/13; F25B 2400/03; F25B 2700/04; F25B 2700/2113; F25B 2700/03; F25B 43/02
See application file for complete search history.

(56) References Cited

U.S. PATENT DOCUMENTS 5,052,897 A 10/1991 Yamashita et al.
5,996,372 A * 12/1999 Koda ..... F25B 43/006 62/503

(Continued)

FOREIGN PATENT DOCUMENTS

CN 103939324 A 7/2014

OTHER PUBLICATIONS

Gao, L. et al., Measurement of oil circulation ratio in CO2 Heat Pump Systems, 2011, 10th IEA Heat Pump Conference.

(Continued)

*Primary Examiner* — Henry T Crenshaw
(74) *Attorney, Agent, or Firm* — Purdue Research Foundation

(57) ABSTRACT

System and methods for oil circulation ratio (OCR) sensing with a suction-line accumulator are provided. The accumulator may include a sensor configured to detect the level of oil. The accumulator may further include a valve which opens when oil is at a high-level and closes when oil is at a low-level. The accumulator may measure a mass flow rate of oil in the vapor compression cycle system based on an amount of time taken to fill a portion of the accumulator. The accumulator may further determine an oil circulation ratio based on the measured time taken to fill the portion of the accumulator. The smart accumulator may output the oil circulation ratio.

15 Claims, 9 Drawing Sheets

(52) U.S. Cl.
CPC ..... *F25B 2700/03* (2013.01); *F25B 2700/04* (2013.01); *F25B 2700/13* (2013.01)

(56) References Cited

U.S. PATENT DOCUMENTS

| | | | | |
|---|---|---|---|---|
| 6,776,029 | B2 | 8/2004 | Hotta et al. | |
| 7,895,846 | B2 | 3/2011 | He et al. | |
| 10,550,885 | B2 | 2/2020 | Yang et al. | |
| 10,556,140 | B2 | 2/2020 | Hulse et al. | |
| 10,557,103 | B2 | 2/2020 | Kaneko et al. | |
| 10,563,107 | B2 | 2/2020 | Nappa et al. | |
| 10,570,323 | B2 | 2/2020 | Ota et al. | |
| 10,584,744 | B2 | 3/2020 | Kozuma et al. | |
| 10,598,413 | B2 | 3/2020 | Ote | |
| 10,604,689 | B2 | 3/2020 | Fukushima | |
| 10,605,492 | B2 | 3/2020 | Ozu et al. | |
| 10,627,138 | B2 | 4/2020 | Mizutani | |
| 10,630,130 | B2 | 4/2020 | Suzuki et al. | |
| 10,641,529 | B2 | 5/2020 | Opalka et al. | |
| 10,655,897 | B2 | 5/2020 | Goel et al. | |
| 10,684,046 | B2 | 6/2020 | Ishiyama et al. | |
| 10,684,055 | B2 | 6/2020 | Goel et al. | |
| 2001/0015078 | A1* | 8/2001 | Schroeder | F25B 43/006 62/503 |
| 2009/0071187 | A1 | 3/2009 | Sakitani | |
| 2011/0239667 | A1* | 10/2011 | Won | F25B 31/004 62/84 |
| 2014/0238060 | A1* | 8/2014 | Tamaki | F25B 49/00 62/127 |
| 2019/0242622 | A1 | 8/2019 | Matsuda | |
| 2020/0292216 | A1* | 9/2020 | Tanawittayakorn | F25B 31/004 |

OTHER PUBLICATIONS

Min, K. et al., Oil circulation rate in rotary compressor: its measurement and factors affecting the rate, 2000, 15th International Compressor Engineering Conference.

Ashrae, 2015. Standard 41.4: Method for measurement of proportion of lubricant in liquid refrigerant, American Society for Heating, in: Refrigeration, and Air-Conditioning Engineers.

* cited by examiner

SMART ACCUMULATOR WITH OIL CIRCULATION RATIO SENSING

CROSS REFERENCE TO RELATED APPLICATIONS

This application claims the benefit of U.S. Provisional Application No. 63/196,891 filed Jun. 4, 2021, the entirety of which is incorporated by reference herein.

TECHNICAL FIELD

This disclosure relates to vapor compression cycle systems and, in particular, to accumulators for vapor compression cycle systems.

BACKGROUND

Oil circulation ratio (OCR) is the ratio of the amount of oil that is circulating in the system outside of the compressor to the total fluid flow and it is one of the key parameters that can help in quantifying the oil management problem in vapor compression cycle systems. Although OCR is dependent on various factors such as the refrigerant mass flow rate, refrigerant properties, temperatures and pressures, it mainly accounts for oil that is discharged from the compressor, which varies for different compressor types and operating conditions. Significantly higher oil discharge from the compressor can occur during transients due to on/off cycling or significant changes in compressor speed.

Due to these effects, the problems of oil discharge and oil return from compressors are expected to escalate when using tandem compressors due to repeated cycling of compressors, and when using variable-speed compressors for a wider range of refrigerant flow rates. However, measuring OCR within a vapor compression cycle is challenging due to various factors, such as phase change of the working fluid at different locations, miscibility between the oil and refrigerant, and varying flow regimes.

BRIEF DESCRIPTION OF THE DRAWINGS

The embodiments may be better understood with reference to the following drawings and description. The components in the figures are not necessarily to scale. Moreover, in the figures, like-referenced numerals designate corresponding parts throughout the different views.

DETAILED DESCRIPTION

Figure 1:
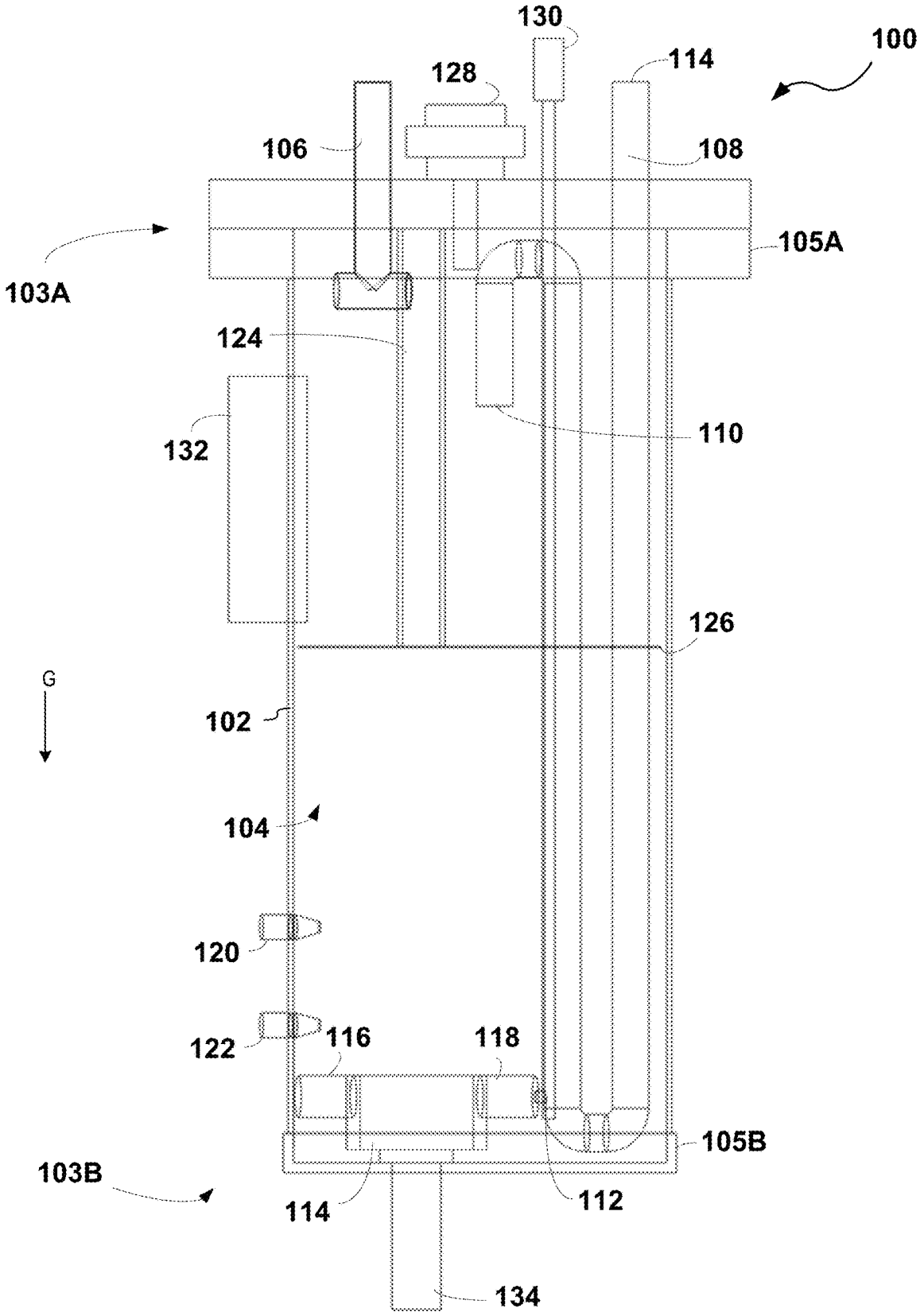
FIG. 1 illustrates a first example of an accumulator.

The American Society of Heating, Refrigerating and Air-Conditioning Engineers (ASHRAE) Standard 41.4 prescribes a gravimetric based method to measure oil circulation ratio (OCR). Measuring OCR with the standard method involves processes such as transferring solvent and oil from the cylinder to a beaker, measuring the mass of substances at a milligram level, and evaporating the solvent from the mixture, which are tedious and prone to human errors. Practically it is not possible to measure more than 3 or 4 samples using such a method at a particular condition. In addition, while taking the sample from the liquid line, if at any condition the oil and refrigerant are not miscible, then it is possible that the sample collected in the cylinder would be non-homogenous.

An in-situ method for measuring oil circulation ratio (OCR) was developed at Herrick Laboratories. This method is based on separating the oil flow from the refrigerant flow in the system and measuring the oil flow rate using a liquid level probe. A major benefit of using this method is that multiple samples of oil can be taken, which will capture the low frequency dynamic behavior of OCR in the system. As the measurement system is automated, it minimizes human error. The oil separation technique used in this method overcomes the shortcoming of measuring OCR for immiscible refrigerant/lubricant pairs, while retaining features such as measuring in real-time, not needing to remove charge and does not require calibration. This method has been experimentally validated with the ASHRAE standard method. The relative differences in the OCR measurement between the liquid level probe and ASHRAE standard methods were less than 12%. The system and methods described herein provide contemplate OCR censoring with aa suction line accumulator. The accumulator protects the compressor in a typical HVAC&R system from liquid slugging and is often utilized in heat pumps, air conditioners, and commercial refrigeration. Integration of the OCR sensing capabilities within an accumulator addresses the issue of small form factor and significantly improves the overall economics. An accumulator protects the compressor by separating out the liquid refrigerant and allows only vapor refrigerant to flow into the compressor. The system and methods described herein provide an accumulator which implements OCR measurement and/or provides pertinent related to OCR.

According to various examples described herein, two level switches positioned may be positioned at pre-calibrated levels within the accumulator thereby eliminating the need of a continuous level reading for determining oil flow rate. The oil separation is performed by obstructing or tabulating the flow of refrigerant/oil into the accumulator so that the oil is separated from the refrigerant vapor. If the separation is not adequate, then a filter can be added. The traditional orifice in the refrigerant vapor return line is replaced with a solenoid valve for controlling the oil flow returning to the compressor, which then helps to implement the developed OCR measurement method in the re-design.

Figure 2:
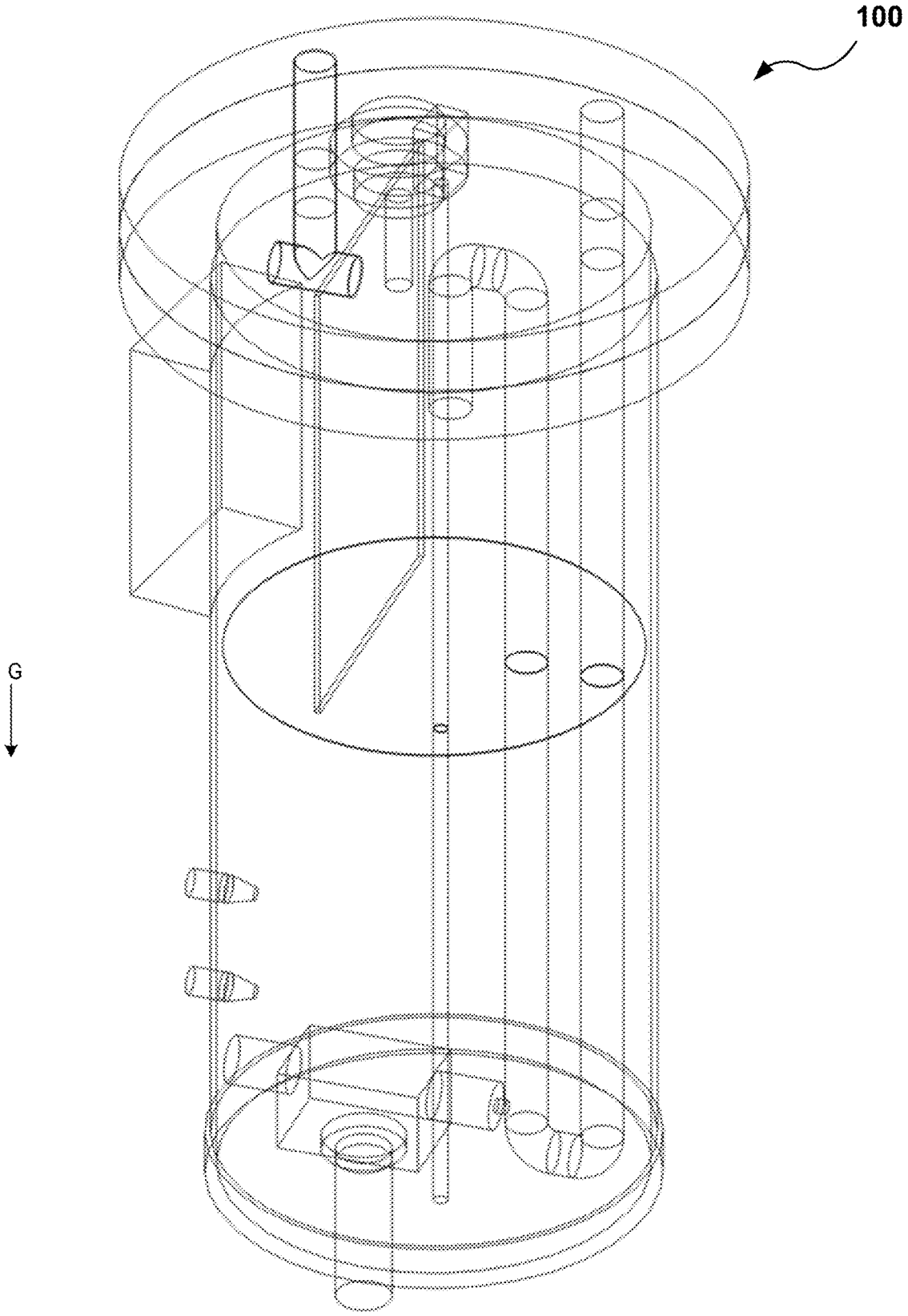
FIG. 2 illustrates a perspective view of the first example of the accumulator.

FIG. 1 illustrates a first example of the smart accumulator 100. FIG. 2 illustrates a perspective view of the accumulator. The smart accumulator 100 may include a shell 102. The shell 102 may include a cylindrical body. In general, the dimensions of the shell 102 may follow form factors of traditional accumulators available on the market. For example, the diameter may be 10 CM and the height may be 20 cm, though other sizes are possible.

The accumulator may have ends 103A-B. For ease of discussion, the terms "top" and "bottom" as used herein are oriented with respect to gravity (G). As described herein, the ends of the accumulator 100, or subcomponents therein, are respectively referred to as the top and the bottom when the accumulator is oriented with respect to gravity. Proximate to the bottom end means closer to the bottom end than the top end. Accordingly, the ends 103A-B may include a top end 103A and a bottom end 103B.

The smart accumulator 100 may include an internal cavity 104. The internal cavity may receive refrigerant and oil during operation. The internal cavity may accumulate oil at the bottom of the internal cavity. The shell 102 may at least partially define the internal cavity 104.

The accumulator may have caps 105A-B. The caps 105A-B may include a top cap 105A and a bottom cap 105B. The caps 105A-B may include respective walls that define the top and bottom of the internal cavity 104. Alternatively, or in addition, the caps may define the outer ends of the accumulator 100. The caps 105A-B, alone or in combination, may be included as part of the shell 102 and/or detachably coupled to shell 102.

The accumulator 100 may include an inlet line 106 to the internal cavity 104. The inlet line 106 may connect to a suction line of a vapor compression cycle system and eject vapor and oil into the internal cavity 104. In some examples, the inlet line 106 may extend through the top end 103A, as shown in FIG. 1. Alternatively, the inlet line 106 may extend through portions of the shell 102 proximate to the top of the accumulator 100. In some examples, the inlet line 106 may divide into a plurality of lines and have multiple openings in the internal cavity. For example, the inlet line 106 may have a T where influent separates and exits two openings.

The accumulator 100 may include an outlet line 108 proximate to or included in the top end 103A. The outlet line 108 may connect to the suction side of a compressor in a vapor compression cycle system. The outlet line 108 may extend through the top end 103A, as shown in FIG. 1. Alternatively, the outlet line 108 may extend through the shell 102 proximate to the top end 103A.

The outlet line 108 may include a vapor inlet 110 disposed in the internal cavity 104 proximate to the top end 103A. The outlet line 108 may also include an oil inlet 112 disposed in the internal cavity 104 proximate to the bottom end 103B. The outlet line 108 may further include an external outlet 114 that has an opening out of the internal cavity 104. The outlet line may be one continuous line or separate lines joined together.

In some examples, the outlet line 108 may be in the form of a S-Tube. For example, the outlet line 108 may extend from the top end 103A to a location proximate to the bottom end 103B, and thereafter, bend and extend back up to a location proximate the top end 103A, and thereafter, bend again such that the inlet 110 of the outlet line 108 is facing the bottom end 103B at a location proximate to the top end 103A.

Refrigerant and oil mixture may enter an inlet line 106. Once inside the accumulator, the refrigerant and oil mixture may separate. Refrigerant may enter the vapor inlet 110 of the outlet line 108. The oil may accumulate in the bottom of the accumulator.

The accumulator 100 may include a valve 114. The valve 114 may include or be connected to an inlet 116 which is disposed in the internal cavity 104 proximate to the bottom end 103B. The value 114 may further include or be connected to an outlet 118 that is connected to the oil inlet 112 of the outlet line 108.

In some examples, the oil inlet may be connected to an oil inlet line which has a smaller diameter, relative to the outlet line, to drain off oil slowly and avoid large slugs of oil returning to the compressor, which may impact the performance.

Accordingly, the valve 114 may control the flow of oil from the bottom of the accumulator to the outlet line 108. As oil becomes separated, it accumulates at the bottom of the accumulator 100. The level of the oil rises until it reaches the level of upper liquid level switch 120, which triggers the controller logic to open the valve 114. When the valve 114 opens, oil from the bottom of the accumulator 100 flows into the outlet line and is drained out of the accumulator 100 by flowing along with the refrigerant vapor through the outlet line 108. The valve 114 may remain open until the oil level reaches the lower liquid level switch 122. When the oil level is at or below the lower liquid level switch 122, the valve 114 is closed to start accumulating the oil again. This cycle of draining and filling oil in the bottom section of the accumulator is repeated to get continuous OCR measurements with discontinuity while the oil is draining in each cycle.

It should be appreciated that in some examples, the valve 114 may be a solenoid valve which can be controlled electronically to actuate the valve 114. Other types of valves and actuation are possible.

In various examples, the accumulator 100 may include features which provide additional or alternative technical advantages. For example, the refrigerant and oil mixture may be deflected from the inlet line 106 to hit an inner wall/surface inside the accumulator. This helps the liquid oil separate out of the refrigerant vapor. For example, the refrigerant and oil mixture may hit the inner surface of the shell 102. Alternatively or in addition, the accumulator 100 may include a baffle 124. The baffle 124 may include, for example, a wall or surface which is oriented to receive inflow from the inlet line 106. As illustrated in FIG. 1, the inlet line may split the inflow such that the inflow mixture hits the inner surface of the shell 102 and the baffle 124. Splitting the flow at the end of the inlet tube 106 may also reduce the refrigerant vapor velocity, which helps in better oil separation. The liquid oil droplets coalesce and drip down to the bottom section of the accumulator.

In some examples, the accumulator 110 may include the divider 126. The divider 126 may provide a support for the baffle and/or return line. A gap may be defined between the divider and the shell such that oil may drain down to the bottom end of the shell. Alternatively or in addition, the divider 126 may have one or more holes that act as drains for the oil.

In some examples, the accumulator 100 may include a pressure sensor 128 and/or temperature probe 130. The analog and/or digital signals from the pressure sensor may represent the pressure inside of the accumulator 100. The analog and/or digital signals from the temperature probe 130 may represent the temperature inside the accumulator and/or the temperature of the oil.

In some examples, the accumulator may include a controller 132. The controller 132 may be onboard and/or affixed to the accumulator. The controller 132 may receive signals from pressure sensor 128, temperature probe 130 and/or the level switches 120-122. Based on the control logic and the received signals, the controller 132 may send signals to open/close the valve 114. Alternatively or in addition, the controller 132 may provide a communications interface for access and/or controlling the valve 114, level switches 120-122, pressure sensor 128, and/or temperature probe 130.

In some examples, the accumulator may include a stem 134 for the valve 114. The stem 134 is a housing of a mechanical valve that can be operated using an electromagnetic coil fitted on the stem 134. Energizing/de-energizing the coil opens/shuts the valve 114 with an electrical signal generated from the controller 132.

The difference in height between the upper and the lower liquid level switches 120-122 may be fixed and define a volume in the internal cavity. Therefore, the amount of the oil-refrigerant mixture between the switches 120-122 can be pre-determined by filling up the volume by known amount (mass) of the oil-refrigerant mixture or based on the volume of the internal cavity between level switches 120-122 and the properties of the oil-refrigerant mixture, such as density or specific volume and solubility. The controller 132 may measure the time taken to fill the oil between the two-level switches. The mass flow rate of oil can then be simply calculated by dividing the mass of oil by the time taken to fill the known amount of oil. With the known mass flow rate of oil, the OCR can be determined by dividing the mass flow rate of oil with the mass flow rate of refrigerant and oil mixture, which can be obtained from a mass flow meter in the liquid line of the vapor compression cycle. In the absence of a mass flow meter, the compressor map may be used to obtain refrigerant and oil mixture mass flow rate.

Figure 3:
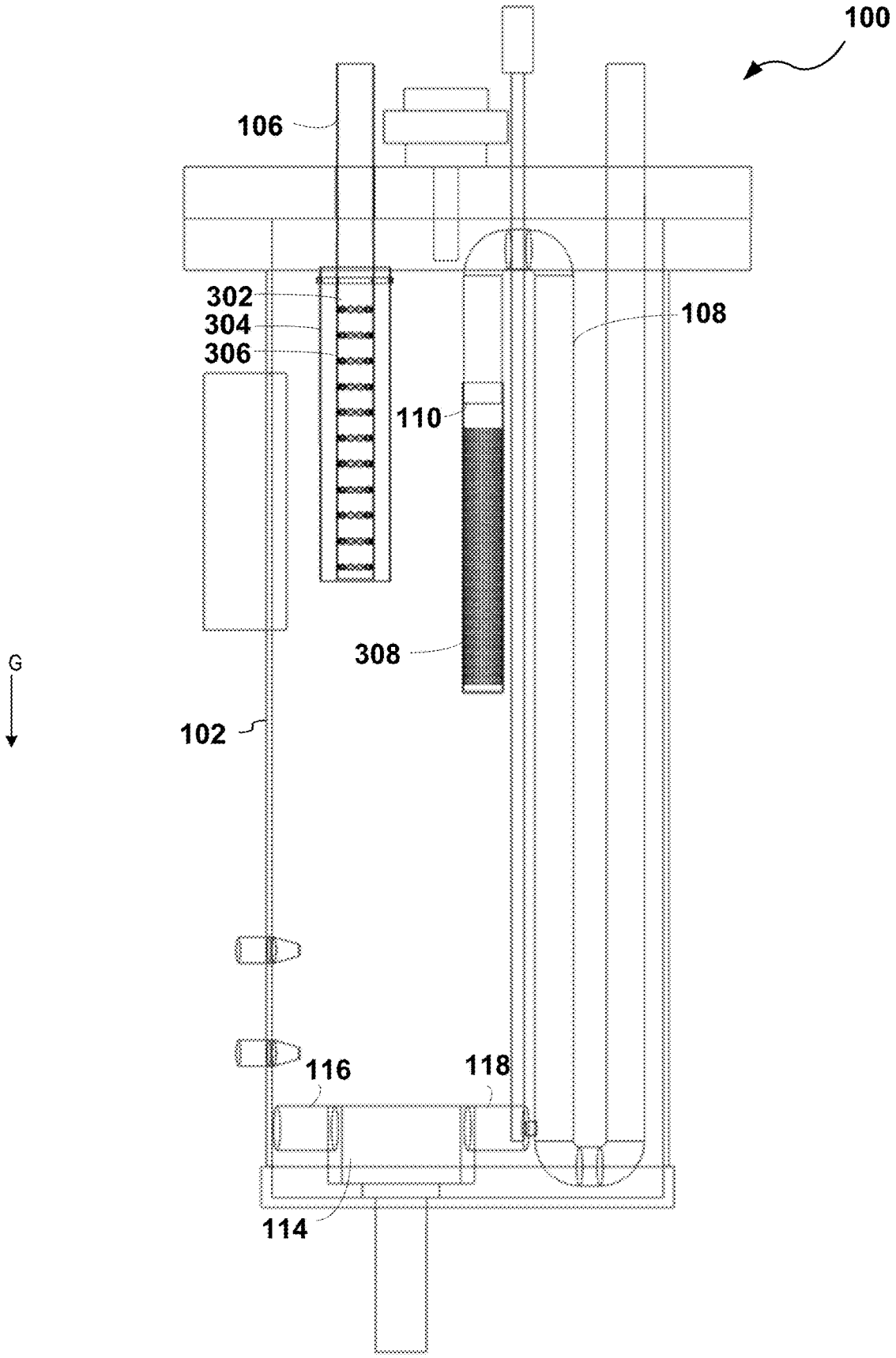
FIG. 3 illustrates a second example of an accumulator.
Figure 4:
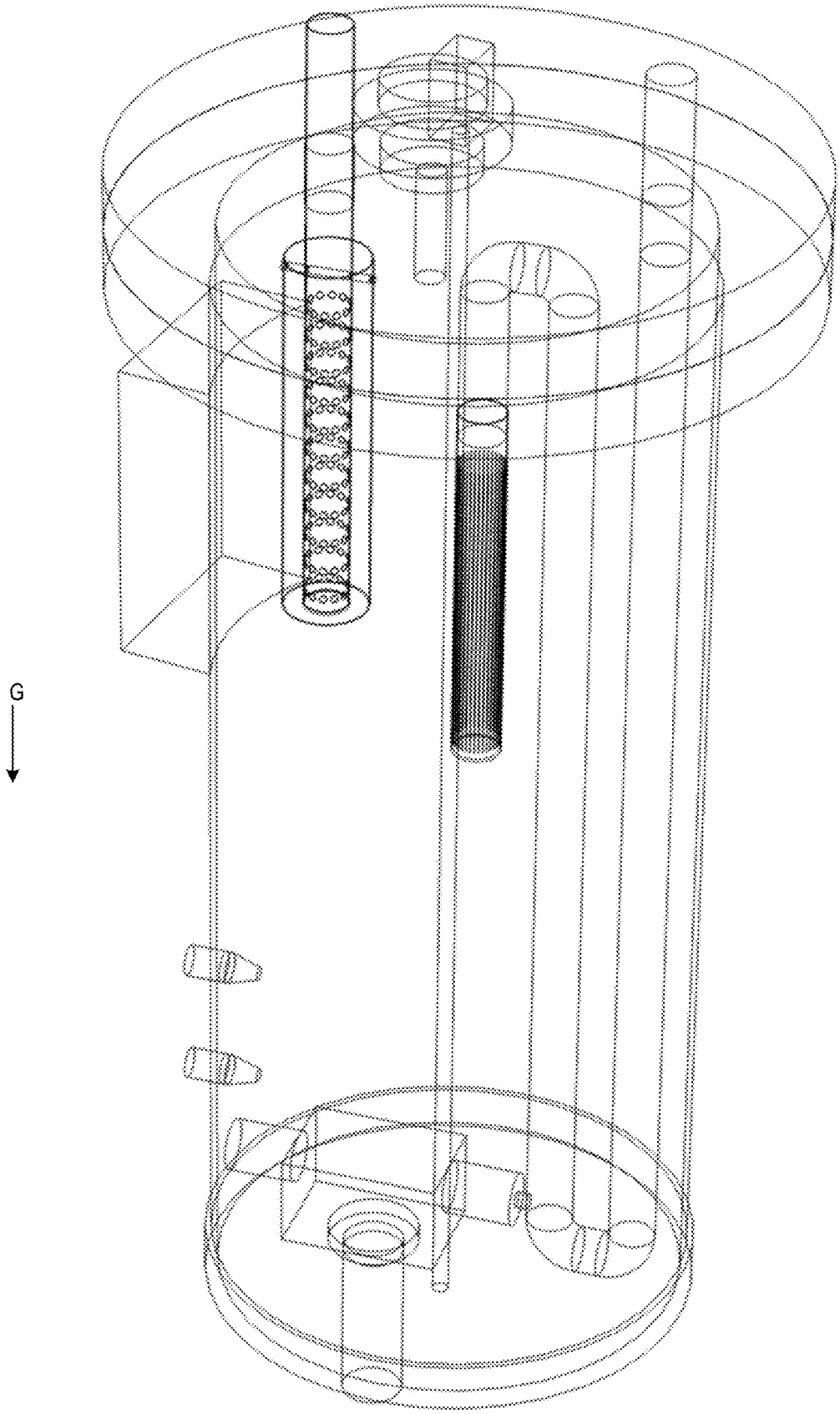
FIG. 4 illustrates a perspective view of the second example of the accumulator.

FIG. 3 illustrates a second example of the accumulator 100. FIG. 4 illustrates a perspective view of the second example of the accumulator 100. The inlet line 106 may include a perforated portion 302 at least partially disposed in or near a shroud 304. In some examples, the shroud 304 may be a cover or wall placed in front of perforation(s) 306 of the inlet line 106. As illustrated in FIG. 3, the perforated portion 302 may include a tube with perforations at various locations along the length of the tube. The shroud 302 may be a cylindrical shroud having an inner wall. The perforated line 302 may be at least partially disposed in the cylindrical shroud 304 such that the vapor and oil mixture outflow from the perforated line 106 are directed onto the inner wall of the cylinder shroud 304.

The inlet tube 106 be closed while the cylindrical shroud 304 may be open at the bottom. Thus, the refrigerant and oil mixture enters an inlet line 106 and is deflected through the perforation holes 306 to hit the inner surface of the cylindrical shroud 304. This helps the liquid oil separate from the refrigerant vapor. Splitting the flow through the holes in the inlet line 106 reduces the refrigerant vapor velocity, which helps in better oil separation. The liquid oil droplets coalesce on the cylindrical shroud 304 and drip down through the gap defined between the inlet line 106 and shroud 304.

In the accumulator 100 illustrated in FIGS. 1-2, there is a T at the end of the inlet line to deflect the refrigerant and oil mixture against the inner wall of the shell and the vertical baffle plate to separate the liquid oil from the refrigerant vapor. In the accumulator 100 illustrated in FIGS. 3-4, the T-shaped inlet line and baffle are replaced with a perforated line 302 and a cylindrical shroud 304 over it to achieve the liquid oil and refrigerant vapor separation.

In some examples, the accumulator 100 may include a filter 308, which may be a part of or connected to the outlet line 108. The filter 308 may be positioned at the vapor inlet 110. The filter 308 may create additional pressure drop between the internal cavity 104 and the inside of the outlet line 108. This additional pressure drop increases the differential pressure across the valve inlet 116 and valve outlet 118 in outlet line 108. This assists in the flow of liquid oil from the bottom of the accumulator 100 to the outlet line 108 when the valve 114 opens upon activation.

Figure 5:
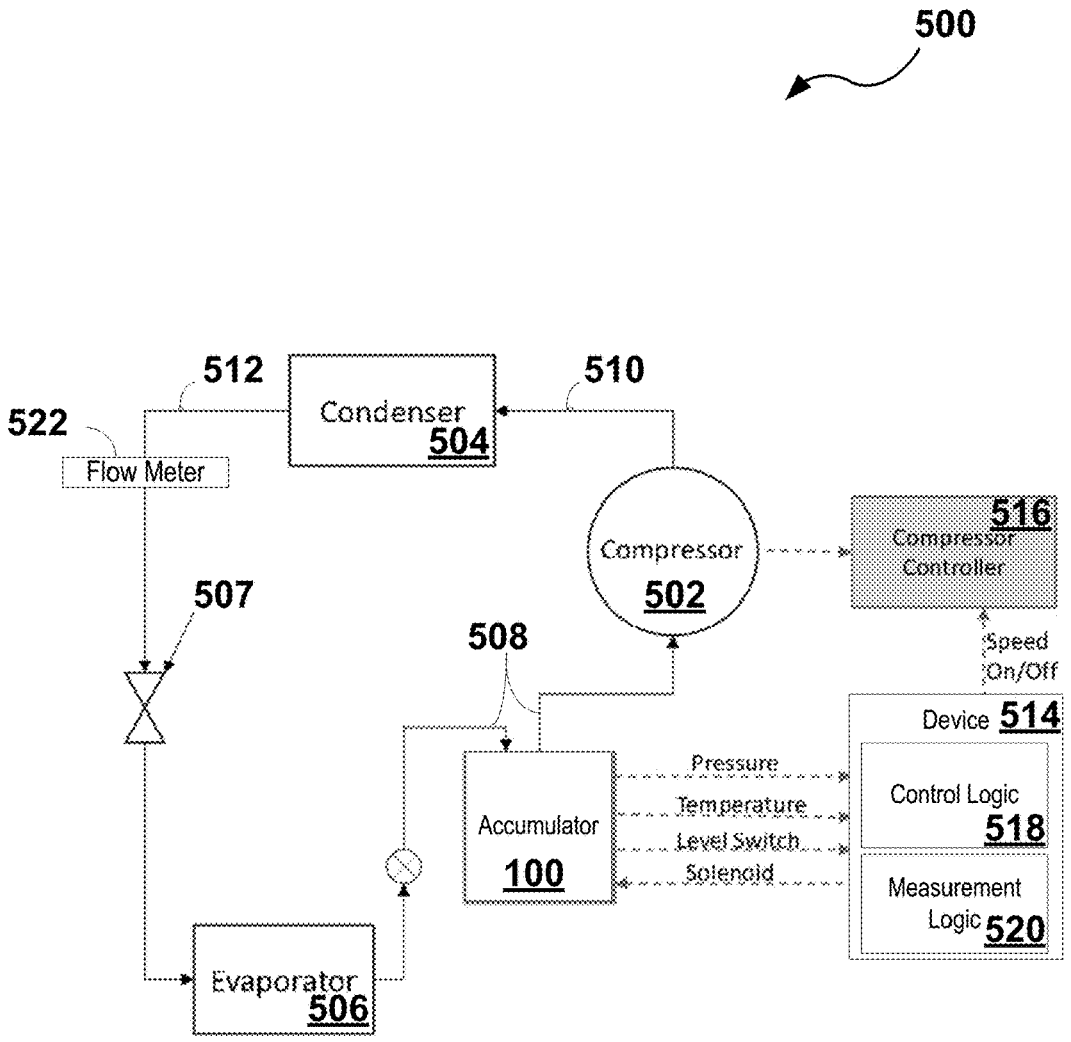
FIG. 5 illustrates an example of a system.

FIG. 5 illustrates an example of a system 500. The system may include a compressor 502, a condenser 504, an evaporator 506, and/or an expansion valve 507 as part of a loop in a vapor compression cycle system. A portion of the loop between the evaporator 506 and compressor 502 is a suction line 508. A portion of the loop between the compressor and condenser is a discharge line 510. A portion of the loop between the condenser and evaporator is a liquid line 512.

The accumulator 100 may be connected to the suction line 508. For example, the connection may be a series connection in which the suction line is diverted through the inlet line and outlet line of the accumulator 100. The benefit of having the accumulator in suction line is to get information of oil flow returning to the compressor from the system.

The system may include a device 514 which may interact with a compressor controller 516 (or the compressor 502 directly), to control the speed of the compressors or turn them on/off to ensure that the compressors does not starve of oil. In a traditional accumulator, the liquid refrigerant may accumulate in the bottom section until the upper level switch is triggered and the liquid refrigerant is flashed back into the suction line 508. The smart accumulator will therefore provide protection to the compressor from liquid flooding as well as from oil starvation. The idea is to make the smart accumulator at a low cost, therefore based on the application, multiple sensors can then be implemented for systems with multi-staged and parallel compressors. It is important to note that the OCR sensing will not function during situations where liquid refrigerant is accumulating and the sensor would be smart to identify when the conditions are OK for OCR sensing.

As illustrated in FIG. 5, the device may include control logic 518 and measurement logic 520. The control logic is further described in reference to FIG. 6 and the measurement logic is further described in reference to FIG. 7. It should be appreciated that, in some examples, the control logic and/or measure logic may reside in memory or circuitry of the accumulator 100 (see FIGS. 8-10).

In some examples the system may include a flow meter 522 which may measure the flow of liquid through the liquid line 512. As described below, the output from the flow meter may be used in monitoring the system including calculating information such as OCR.

Figure 6:
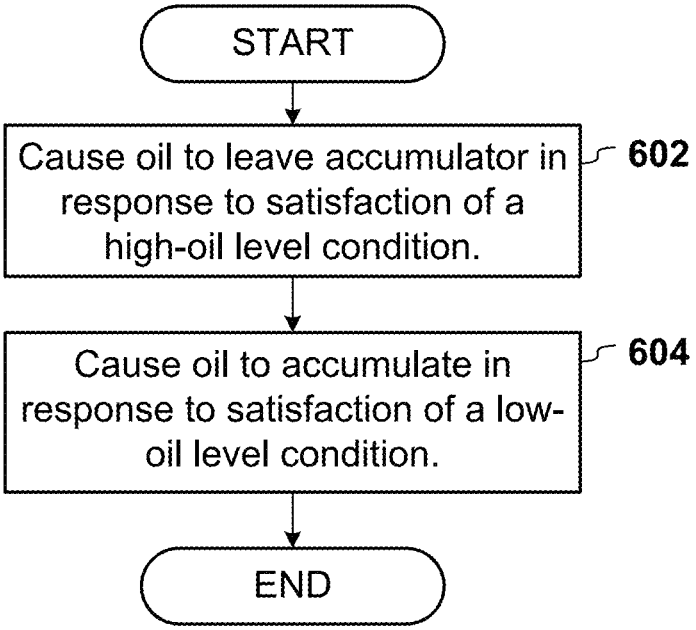
FIG. 6 illustrates a flow diagram for an example of control logic.

FIG. 6 illustrates a flow diagram for an example of the control logic 518. Reference to FIG. 1 and FIG. 5 are made through the following discussion of the control logic 518 illustrated in FIG. 6.

The control logic 518 may cause oil to leave accumulator in response to satisfaction of a high-oil level condition (602). For example, as oil accumulates in the bottom of the accumulator 100, it will eventually reach a level where it triggers the high-level switch 120. The high-level switch 120 may indicate the oil is at a particular level which satisfies a high-oil level condition. Accordingly, the control logic 518 may cause the valve 114 to open thereby allowing oil to flow out of the accumulator and the oil level to fall.

The control logic 518 may cause oil to accumulate in response to satisfaction of a low-oil level condition (604). For example, the control logic 518 may cause valve 114 to close in response to the oil level being at or below the low-level switch 122.

In some examples, when the oil level is detected to be at or near a first predefined level (i.e. the location of the low-level switch) the control logic 518 may output a start time and/or begin a timer for measuring oil accumulation. In some examples, the control logic 518 may output an end time and/or end the timer in response to the oil accumulating to a second predetermined level (i.e. the location of the high-level switch 120).

Figure 7:
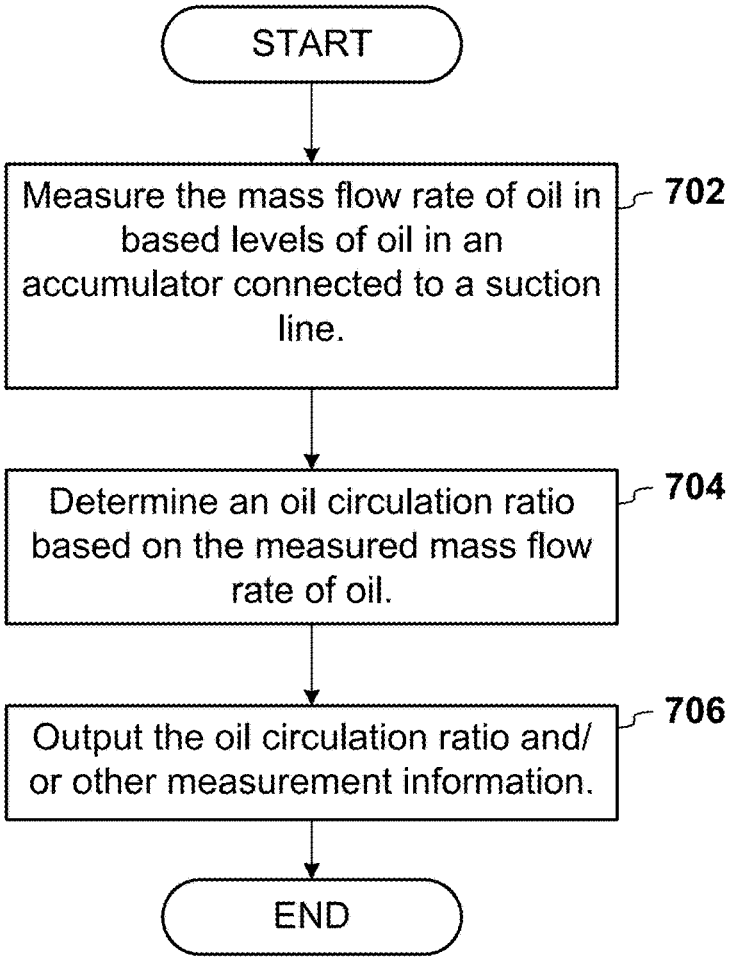
FIG. 7 illustrates flow diagram for an example of measurement logic.

FIG. 7 illustrates flow diagram for an example of the measurement logic 520. Reference to FIG. 1 and FIG. 5 are made through the following discussion of the control logic 518 illustrated in FIG. 7.

The measurement logic 520 measure the mass flow rate of oil in based levels of oil in an accumulator connected to the suction line 508 (702). For example, the accumulator may measure an amount of time taken to fill the volume of the accumulator between the high-level switch and low-level switch. There are various ways in which this time value can be calculated. For example, measurement logic may receive a signal that the oil has reached the low-level mark and being timing. Then the measurement logic may receive a signal that the oil level has reached a high-level mark and stop timing. In other examples, other circuitry or logic, such as the control logic, may receive signals from the switches and calculate the time value, which is then relayed to the control logic.

In general, the mass flow rate of oil may be calculated by:

$$\dot{m}_{oil} = \frac{m_{oil,end} - m_{oil,start}}{t_{end} - t_{start}} \tag{1}$$

where $m_{oil,end}$ is the mass of oil in the accumulator when the oil is at the high-level switch, $m_{oil,start}$ is the mass of oil in the accumulator when the oil is at the low-level switch, $t_{end}$ is the time the high level switch was triggered and, $t_{start}$ is the time the low level switch was triggered. However, it should be appreciated that liquid oil accumulating in the accumulator may have some amount of liquid refrigerant dissolved in it.

The solubility of this liquid refrigerant in oil is a function of temperature and pressure inside the vessel. Based on the solubility curves and measured pressure and temperature inside accumulator, the oil flow rate can be corrected in real-time to account for the amount of liquid refrigerant dissolved in the oil. Depending on the refrigerant-oil chemistry, there is some amount of liquid refrigerant dissolved in the oil. For a given refrigerant/oil pair, concentration of the refrigerant in the oil ($w_{ref}$) is a function of temperature and pressure. And the density of the refrigerant and oil mixture ($\rho_{mix}$) is a function of temperature and refrigerant concentration. Seeton and Hrnjak (2006) describes an experimental procedure to develop empirical correlations that correlates refrigerant concentration and mixture density for temperature and vapor pressure. Equation (2) and Equation (3) show the suggested form of correlations, where the constants $a_1$ through $a_9$ are empirical correlation constants, the temperature, T, is in Kelvin; $w_{ref}$, is liquid phase mass fraction of refrigerant and the pressure, P, is in bar. As an example.

The mass flow rate may also be calculated as $$\dot{m}_{oil} = \frac{\Delta V \rho_{mix,avg}(1 - w_{ref,avg})}{t_{end} - t_{start}} \tag{6}$$

where ΔV is a pre-defined value which is the fixed geometrical volume between the high-level switch and the low-level switch, $\rho_{mix,avg}$ is the average density of oil-refrigerant mixture between the start and the end and $w_{ref,avg}$ is the average refrigerant concentration of refrigerant in oil between the start and the end.

Table 1 provides the correlation constants for the refrigerant/oil (R410A/POE32).

$$Log_{10}(P) = a_1 + \frac{a_2}{T} + \frac{a_3}{T^2} + Log_{10}(w_{ref})\left(a_4 + \frac{a_5}{T} + \frac{a_6}{T^2}\right) + Log_{10}^2(w_{ref})\left(a_7 + \frac{a_8}{T} + \frac{a_9}{T^2}\right) \tag{2}$$

$$\rho_{mix} = a_1 + a_2T + a_3T^2 + w_{ref}(a_4 + a_5T + a_6T^2) + w_{ref}^2(a_7 + a_8T + a_9T^2) \tag{3}$$

With the calculated concentration of refrigerant ($w_{ref}$), and the refrigerant-oil mixture density ($\rho_{mix}$) based on the pressure and temperature measurement in the accumulator, the mass of oil in the accumulator can be corrected at the start, when the low-level switch triggers, and at the end, when the high-level switch triggers, as shown in Equation (4) and (5).

$$m_{oil,start} = \rho_{mix,start} V_{start}(1 - w_{ref,start}) \tag{4}$$

$$m_{oil,end} = \rho_{mix,end} V_{end}(1 - w_{ref,end}) \tag{5}$$

where $V_{start}$ is the volume of oil stored in the accumulator when the low-level switch gets activated and $V_{end}$ is the volume of oil stored in the accumulator when the high-level switch gets activated.

The mass flow rate may also be calculated as $$\dot{m}_{oil} = \frac{\Delta V \rho_{mix,avg}(1 - w_{ref,avg})}{t_{end} - t_{start}} \tag{6}$$

where ΔV is a pre-defined value which is the fixed geometrical volume between the high-level switch and the low-level switch, $\rho_{mix,avg}$ is the average density of oil-refrigerant mixture between the start and the end and $w_{ref,avg}$ is the average refrigerant concentration of refrigerant in oil between the start and the end.

TABLE 1

Solubility coefficients for POE32/R410A

| Coeff # | Refrigerant Concentration | Density |
|---|---|---|
| a1 | 3.60143E+00 | 1.17214E+00 |
| a2 | −1.08891E+02 | −8.14484E−04 |
| a3 | −1.58038E+05 | 1.38164E−07 |
| a4 | −5.51901E−01 | 5.66500E−01 |
| a5 | 1.06396E+03 | −1.61081E−03 |
| a6 | −2.17870E+05 | 1.41747E−06 |
| a7 | −2.44225E−01 | 2.99736E−01 |
| a8 | 1.36592E+02 | −1.07000E−03 |
| a9 | −3.15204E+04 | −3.21507E−07 |

The measurement logic may determine an oil circulation ratio based on the measured mass flow rate of oil (704). One way to express OCR is:

$$OCR = \frac{\dot{m}_{oil}}{\dot{m}_{ref}} \tag{7}$$

where $\dot{m}_{oil}$ is previously described and value $\dot{m}_{ref}$ is a reference mass flow rate that includes the refrigerant and oil mass flow rate. The reference mass flow rate $\dot{m}_{ref}$ may be obtained by the flow meter in the system. For example, the flow meter may be positioned on the high-pressure (liquid line) of the vapor compression system.

The measurement logic may output the oil circulation ratio and/or other measurement information (706). For example, the controller may store the OCR measurement in a memory, display the OCR measurement, communicate the OCR measurement over a network, or otherwise digitally provide the OCR measurement according to a communications protocol. Other measurement information may include oil level measurements, accumulation start/stop times, oil mass flow rates, and/or any other information generated by the temperature probe, pressure sensor, level sensors, valve, and/or other sensors or actuators included with the accumulator 100.

The measurement logic 520 and/or control logic 518 may include additional, fewer, or different steps than illustrated. By way of example, the measurement logic may instead output the mass flow rate of oil with or without calculating the OCR. The control logic may output the start time, stop time, duration, pressure measurement, temperature measurement, etc. In other examples, the measurement logic and control logic may be combined.

In some examples, the control logic may perform other additional or alternative actions based on measurements. Referring to FIG. 5, the control logic may vary the speed of the compressor. The OCR measurement may provide the input to a condition to which the compressor speed may be increased to bring back the oil trapped in the system back to the compressor.

The system may be implemented in various ways with or without various components. As previously discussed, the control logic and measurement logic may be located in the smart accumulator. Alternatively or in addition, the control logic and measurement logic, alone or in combination, may be implemented in other devices. FIGS. 8-11 provide various examples of the system 500.

Figure 8:
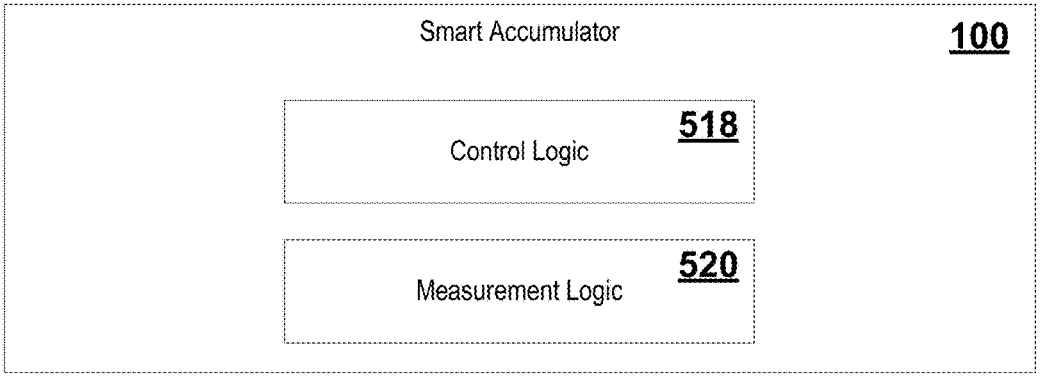
FIG. 8 illustrates an example of a smart accumulator having control logic and measurement logic.
Figure 9:
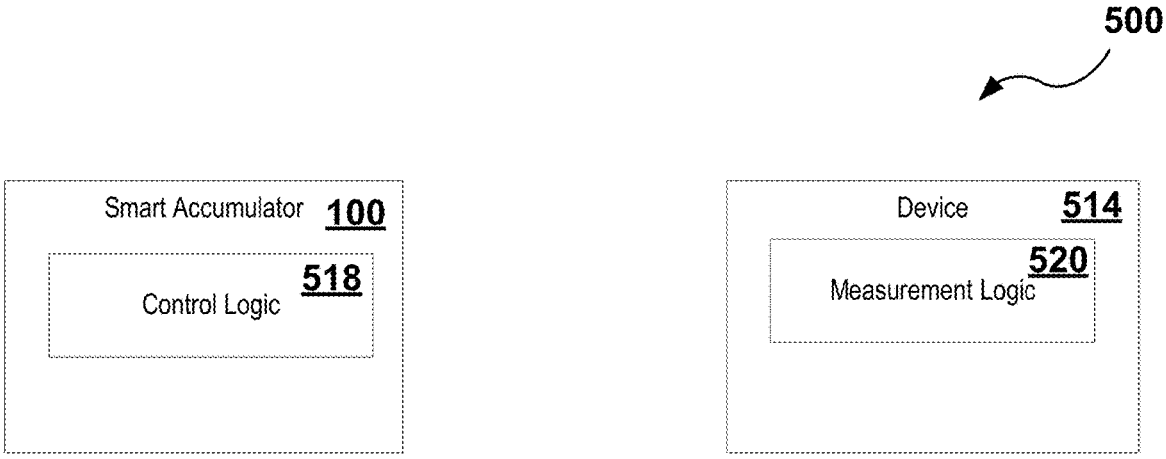
FIG. 9 illustrates a second example of a system including an accumulator and a device.

FIG. 8 illustrates an example of the smart accumulator 100 having both the control logic and measurement logic. FIG. 9 illustrates a second example of the system 100 including the accumulator 100 and a device 514. The device 514 may include a physical or virtual computer in communication with the smart accumulator 100. In some examples, the device 514 may communicate with the smart accumulator 100 over a network.

Figure 10:
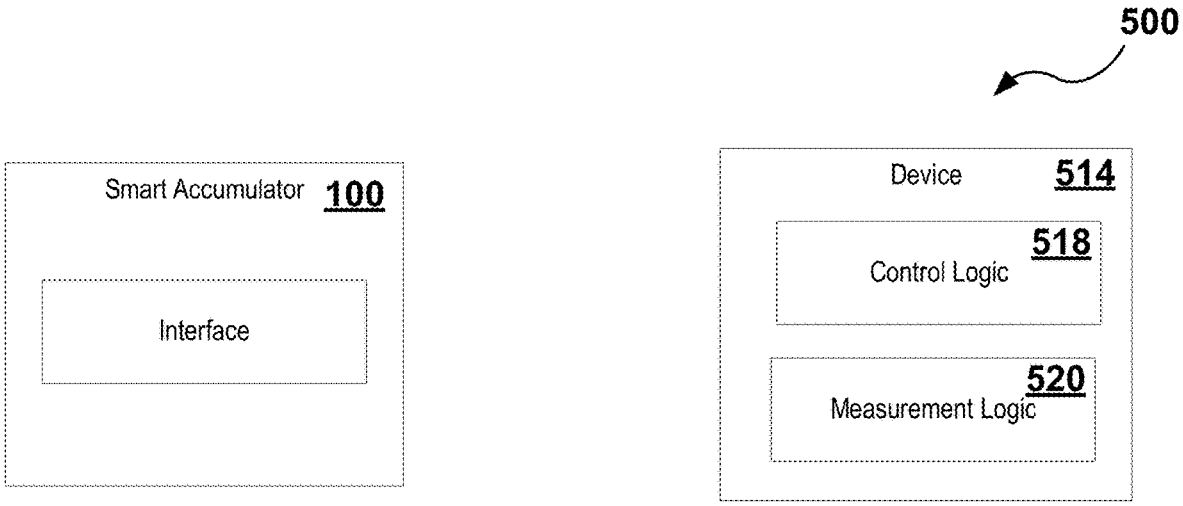
FIG. 10 illustrates a third example of the system where smart accumulator includes an interface.

FIG. 10 illustrates a third example of the system where smart accumulator 100 includes an interface for communicating measurement information and/or control information related to the valve, switches, temperature sensor, and/or pressure sensor.

It should be appreciated that other implementations are possible, for example, the measurement logic 520 and control logic 518 may be on separate devices.

Figure 11:
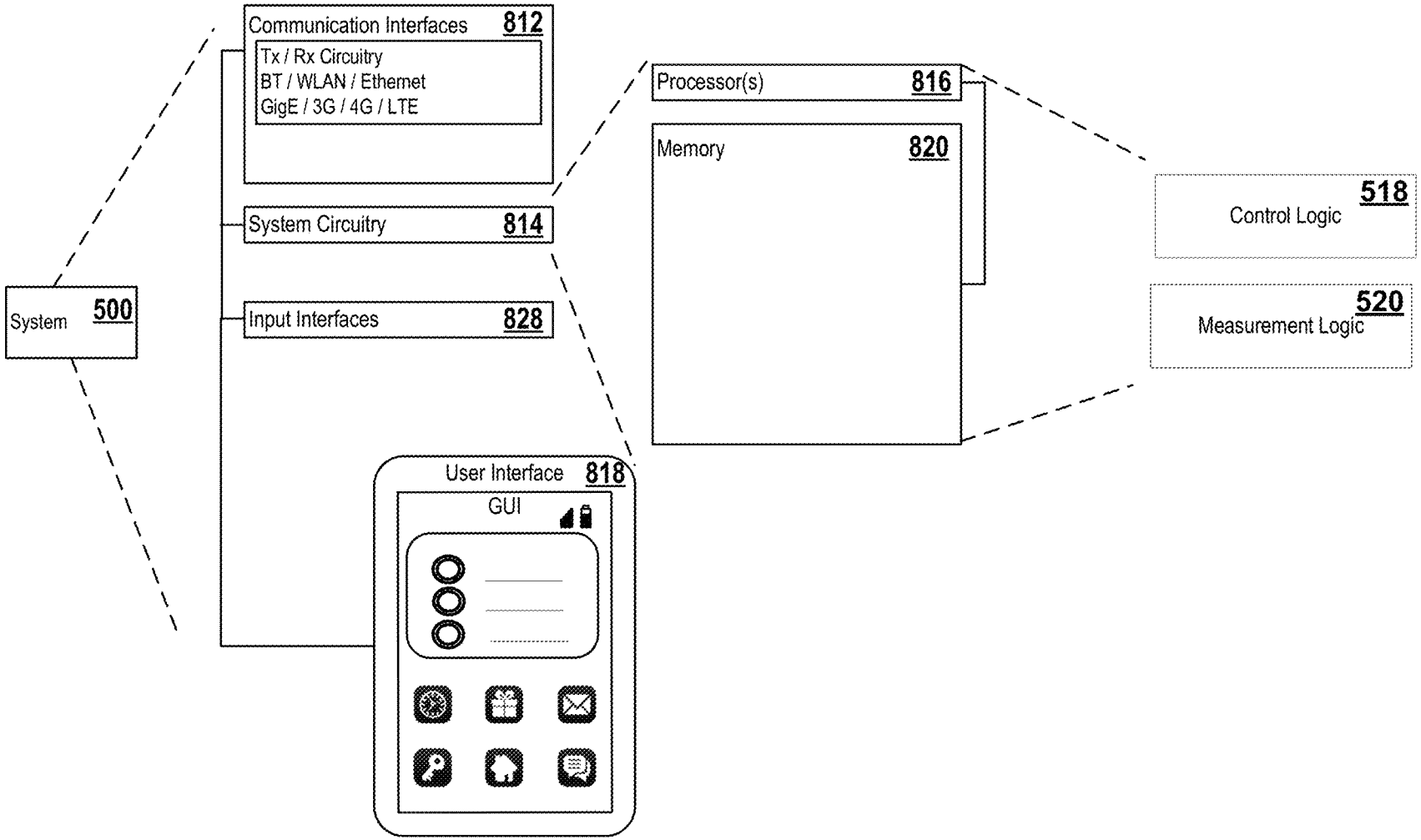
FIG. 11 illustrates a fourth example of the system.

FIG. 11 illustrates a fourth example of the system 500. The system 500 may include communication interfaces 812, input interfaces 828 and/or system circuitry 814. The system circuitry 814 may include a processor 816 or multiple processors. Alternatively or in addition, the system circuitry 814 may include memory 820.

The processor 816 may be in communication with the memory 820. In some examples, the processor 816 may also be in communication with additional elements, such as the communication interfaces 812, the input interfaces 828, and/or the user interface 818. Examples of the processor 816 may include a general processor, a central processing unit, logical CPUs/arrays, a microcontroller, a server, an application specific integrated circuit (ASIC), a digital signal processor, a field programmable gate array (FPGA), and/or a digital circuit, analog circuit, or some combination thereof.

The processor 816 may be one or more devices operable to execute logic. The logic may include computer executable instructions or computer code stored in the memory 820 or in other memory that when executed by the processor 816, cause the processor 816 to perform the operations measurement logic 520, control logic 518, and/or the system 500. The computer code may include instructions executable with the processor 816.

The memory 820 may be any device for storing and retrieving data or any combination thereof. The memory 820 may include non-volatile and/or volatile memory, such as a random access memory (RAM), a read-only memory (ROM), an erasable programmable read-only memory (EPROM), or flash memory. Alternatively or in addition, the memory 820 may include an optical, magnetic (hard-drive), solid-state drive or any other form of data storage device. The memory 820 may include at least one of the measurement logic 520, control logic 518, and/or the system 500. Alternatively or in addition, the memory may include any other component or sub-component of the system 500 described herein.

The user interface 818 may include any interface for displaying graphical information. The system circuitry 814 and/or the communications interface(s) 812 may communicate signals or commands to the user interface 818 that cause the user interface to display graphical information. Alternatively or in addition, the user interface 818 may be remote to the system 500 and the system circuitry 814 and/or communication interface(s) may communicate instructions, such as HTML, to the user interface to cause the user interface to display, compile, and/or render information content. In some examples, the content displayed by the user interface 818 may be interactive or responsive to user input. For example, the user interface 818 may communicate signals, messages, and/or information back to the communications interface 812 or system circuitry 814.

The system 500 may be implemented in different ways. In some examples, the system 500 may be implemented with one or more logical components. For example, the logical components of the system 500 may be hardware or a combination of hardware and software. The logical components may include the measurement logic 520, control logic 518, or any component or subcomponent of the system 500 that can be executed algorithmically. In some examples, each logic component may include an application specific integrated circuit (ASIC), a Field Programmable Gate Array (FPGA), a digital logic circuit, an analog circuit, a combination of discrete circuits, gates, or any other type of hardware or combination thereof. Alternatively or in addition, each component may include memory hardware, such as a portion of the memory 820, for example, that comprises instructions executable with the processor 816 or other processor to implement one or more of the features of the logical components. When any one of the logical components includes the portion of the memory that comprises instructions executable with the processor 816, the component may or may not include the processor 816. In some examples, each logical component may just be the portion of the memory 820 or other physical memory that comprises instructions executable with the processor 816, or other processor(s), to implement the features of the corresponding component without the component including any other hardware. Because each component includes at least some hardware even when the included hardware comprises software, each component may be interchangeably referred to as a hardware component.

Some features are shown stored in a computer readable storage medium (for example, as logic implemented as computer executable instructions or as data structures in memory). All or part of the system and its logic and data structures may be stored on, distributed across, or read from one or more types of computer readable storage media. Examples of the computer readable storage medium may include a hard disk, a floppy disk, a CD-ROM, a flash drive, a cache, volatile memory, non-volatile memory, RAM, flash memory, or any other type of computer readable storage medium or storage media. The computer readable storage medium may include any type of non-transitory computer readable medium, such as a CD-ROM, a volatile memory, a non-volatile memory, ROM, RAM, or any other suitable storage device.

The processing capability of the system may be distributed among multiple entities, such as among multiple processors and memories, optionally including multiple distributed processing systems. Parameters, databases, and other data structures may be separately stored and managed, may be incorporated into a single memory or database, may be logically and physically organized in many different ways, and may implemented with different types of data structures such as linked lists, hash tables, or implicit storage mechanisms. Logic, such as programs or circuitry, may be combined or split among multiple programs, distributed across several memories and processors, and may be implemented in a library, such as a shared library (for example, a dynamic link library (DLL).

All of the discussion, regardless of the particular implementation described, is illustrative in nature, rather than limiting. For example, although selected aspects, features, or components of the implementations are depicted as being stored in memory(s), all or part of the system or systems may be stored on, distributed across, or read from other computer readable storage media, for example, secondary storage devices such as hard disks, flash memory drives, floppy disks, and CD-ROMs. Moreover, the various logical units, circuitry and screen display functionality is but one example of such functionality and any other configurations encompassing similar functionality are possible.

The respective logic, software or instructions for implementing the processes, methods and/or techniques discussed above may be provided on computer readable storage media. The functions, acts or tasks illustrated in the figures or described herein may be executed in response to one or more sets of logic or instructions stored in or on computer readable media. The functions, acts or tasks are independent of the particular type of instructions set, storage media, processor or processing strategy and may be performed by software, hardware, integrated circuits, firmware, micro code and the like, operating alone or in combination. Likewise, processing strategies may include multiprocessing, multitasking, parallel processing and the like. In one example, the instructions are stored on a removable media device for reading by local or remote systems. In other examples, the logic or instructions are stored in a remote location for transfer through a computer network or over telephone lines. In yet other examples, the logic or instructions are stored within a given computer and/or central processing unit ("CPU").

Furthermore, although specific components are described above, methods, systems, and articles of manufacture described herein may include additional, fewer, or different components. For example, a processor may be implemented as a microprocessor, microcontroller, application specific integrated circuit (ASIC), discrete logic, or a combination of other type of circuits or logic. Similarly, memories may be DRAM, SRAM, Flash or any other type of memory. Flags, data, databases, tables, entities, and other data structures may be separately stored and managed, may be incorporated into a single memory or database, may be distributed, or may be logically and physically organized in many different ways. The components may operate independently or be part of a same apparatus executing a same program or different programs. The components may be resident on separate hardware, such as separate removable circuit boards, or share common hardware, such as a same memory and processor for implementing instructions from the memory. Programs may be parts of a single program, separate programs, or distributed across several memories and processors.

A second action may be said to be "in response to" a first action independent of whether the second action results directly or indirectly from the first action. The second action may occur at a substantially later time than the first action and still be in response to the first action. Similarly, the second action may be said to be in response to the first action even if intervening actions take place between the first action and the second action, and even if one or more of the intervening actions directly cause the second action to be performed. For example, a second action may be in response to a first action if the first action sets a flag and a third action later initiates the second action whenever the flag is set.

To clarify the use of and to hereby provide notice to the public, the phrases "at least one of <A>, <B>, . . . and <N>" or "at least one of <A>, <B>, . . . <N>, or combinations thereof" or "<A>, <B>, . . . and/or <N>" are defined by the Applicant in the broadest sense, superseding any other implied definitions hereinbefore or hereinafter unless expressly asserted by the Applicant to the contrary, to mean one or more elements selected from the group comprising A, B, . . . and N. In other words, the phrases mean any combination of one or more of the elements A, B, . . . or N including any one element alone or the one element in combination with one or more of the other elements which may also include, in combination, additional elements not listed.

While various embodiments have been described, it will be apparent to those of ordinary skill in the art that many more embodiments and implementations are possible. Accordingly, the embodiments described herein are examples, not the only possible embodiments and implementations.

What is claimed is:

1. An accumulator for a vapor compression cycle system comprising:

a shell defining an internal cavity;

an inlet line to the internal cavity proximate to a top end of the shell, the inlet line configured to eject vapor and oil into the internal cavity;

an outlet line having a vapor inlet proximate to the top end, an oil inlet proximate to the bottom end, and an outlet that extends out of the internal cavity of the shell;

a valve; an upper level switch; a lower level switch; and a baffle, wherein the valve is configured open and cause to flow into the outlet line when oil is at the upper level switch and the valve is configured to close when oil reaches the lower level switch, and wherein the inlet line is configured to eject oil and vapor into the internal cavity and onto the baffle.

2. The accumulator of claim 1, wherein the inlet line extends through the top end of the shell and curves toward the baffle.

3. The accumulator of claim 1, wherein the baffle comprises a surface oriented between 30 and 90 degrees with respect to the top end of the baffle.

4. An accumulator for a vapor compression cycle system comprising:

a shell defining an internal cavity;

an inlet line to the internal cavity proximate to a top end of the shell, the inlet line configured to eject vapor and oil into the internal cavity;

an outlet line having a vapor inlet proximate to the top end, an oil inlet proximate to the bottom end, and an outlet that extends out of the internal cavity of the shell;

a valve; an upper level switch; and a lower level switch, wherein the valve is configured open and cause to flow into the outlet line when oil is at the upper level switch and the valve is configured to close when oil reaches the lower level switch, and wherein the accumulator further includes a shroud disposed inside of the accumulator wherein the inlet line comprises at least one perforation configured to direct oil and vapor onto the shroud.

5. The accumulator of claim 4, wherein the shroud is cylindrical, and the at least one perforation is disposed in the cylindrical shroud.

6. The accumulator of claim 1, further comprising a filter upstream of the vapor inlet to increase the differential pressure across the valve.

7. A system, comprising:

an accumulator connected to a suction line of a vapor compression cycle system, the accumulator comprising a sensor configured to detect the level of oil and a valve, wherein the valve opens when oil is at a high-level and closes when oil is at a low-level;

a processor configured to measure a mass flow rate of oil in the vapor compression cycle system based on an amount of time taken to fill a portion of the accumulator, determine an oil circulation ratio based on the measured time taken to fill the portion of the accumulator; and output the oil circulation ratio.

8. The system of claim 7, wherein to determine the oil circulation ratio based on the measured time taken to fill the portion of the accumulator, the processor is further configured to:

determine a mass flow rate of oil in the system based on a mass of oil in the system and the time taken to fill the portion, obtain a mass flow rate of liquid refrigerant and oil in the vapor compression cycle system; and calculate the oil circulation ratio based on the mass flow rate of oil and the mass flow rate of refrigerant.

9. The system of claim 8, further comprising:

a flow meter connected to the liquid line downstream of a condenser, wherein the processor is further configured to derive the mass flow rate of liquid refrigerant and oil from output of the flow meter.

10. The system of claim 7, wherein to measure the amount of time taken to fill the portion of the accumulator, the processor is further configure to:

measure a time duration to fill a volume of the accumulator defined between pre-determined levels in the accumulator.

11. The system of claim 7, wherein the sensor comprises a high level switch and a low-level switch.

12. A method comprising:

accumulating oil in an accumulator attached to a suction line of a vapor compression cycle system, determining a mass flow rate of oil based on time taken to fill a volume in the accumulator;

determining a mass flow rate of liquid refrigerant and oil in the vapor compression cycle system;

calculate an oil circulation ratio based on mass flow rate of oil and the mass flow rate of liquid refrigerant and oil; and output the oil circulation ratio.

13. The method of claim 12, further comprising measuring the amount of time taken to fill a volume defined by a high-level switch and a low-level switch.

14. The method of claim 11, wherein determining a mass flow rate of liquid refrigerant and oil in the vapor compression cycle system further comprises receiving mass flow rate information from a flow meter connected to a liquid line of the vapor compression cycle system.

15. The method of claim 12, wherein to determine a mass flow rate of oil in the system based the time taken to fill the volume of the accumulator further comprises:

calculating the mass flow rate of oil based on a first metric representative of the mass of oil in the volume and a second metric representative of the time taken to fill the volume.

* * * * *